US007059742B2

(12) United States Patent
Chen

(10) Patent No.: US 7,059,742 B2
(45) Date of Patent: Jun. 13, 2006

(54) FLASHLIGHT WITH POWER SUPPLY ADAPTER

(75) Inventor: Joy Chen, Burlingame, CA (US)

(73) Assignee: Pentagon Scientific Corporation, Burlingame, CA (US)

( * ) Notice: Subject to any disclaimer, the term of this patent is extended or adjusted under 35 U.S.C. 154(b) by 0 days.

(21) Appl. No.: 10/861,394

(22) Filed: Jun. 7, 2004

(65) Prior Publication Data

US 2005/0225969 A1 Oct. 13, 2005

(30) Foreign Application Priority Data

Feb. 4, 2004 (TW) ..... 93201629 U

(51) Int. Cl.
*F21L 4/08* (2006.01)

(52) U.S. Cl. ..... 362/183; 362/205; 362/203; 362/184

(58) Field of Classification Search ..... 446/485; 362/183, 20, 205, 203, 184; 320/116, 124, 320/126, 103

See application file for complete search history.

(56) References Cited

U.S. PATENT DOCUMENTS

| | | | | |
|---|---|---|---|---|
| 4,772,990 | A * | 9/1988 | Linehan et al. | 362/183 |
| 5,064,988 | A * | 11/1991 | E'nama et al. | 219/121.6 |
| 5,272,606 | A * | 12/1993 | Blaney | 362/157 |
| 5,564,814 | A * | 10/1996 | Anderson | 362/109 |
| 6,616,296 | B1 * | 9/2003 | Roux et al. | 362/184 |
| 6,620,024 | B1 * | 9/2003 | Choi | 446/485 |
| 2004/0252497 | A1 * | 12/2004 | Lim | 362/202 |

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

A flashlight with power supply adapter comprising a front light housing with a light bulb in the tip of the main body of the flashlight. There is a compartment in the main body for storing a rechargeable battery and a spare battery. There are also an on/off switch and a battery select switch for selecting between the rechargeable battery and the spare battery. During use, when the power of the rechargeable battery is drained, the flashlight can still be made to work by changing the battery select switch to the spare battery. As a result, the flashlight is still powered even after the main battery is used.

10 Claims, 3 Drawing Sheets

FLASHLIGHT WITH POWER SUPPLY ADAPTER

BACKGROUND OF THE INVENTION

1. Field of the Invention

The present invention relates to a flashlight power supply adapter. More specifically, the present invention discloses a flashlight power supply adapter with flexible power supply selection, in order to prolong the length of usage.

2. Description of the Prior Art

Conventional flashlights require a constant battery source to be able to function continuously. For people who frequently use flashlights, it seems a waste of time and is not very economical. Therefore, rechargeable flashlights were invented which allow a rechargeable battery to be chosen as the power source, in order to reduce the expense and save the trouble of buying and changing batteries all the time. Although flashlights with rechargeable batteries are economical, when the battery is completely used it still needs to be recharged before being able to be used again. This is inconvenient if the user is working outdoors. Thus, there is need for a flashlight that can still function when the rechargeable battery is dead.

Due to the disadvantages and imperfections of the existing rechargeable flashlight or flashlight with a rechargeable battery, the present invention solves the mentioned problems, and provides a flashlight with a power supply adapter; in order to provide a better, more economical and convenient product.

SUMMARY OF THE INVENTION

To achieve these and other advantages and in order to overcome the disadvantages of the conventional method in accordance with the purpose of the invention as embodied and broadly described herein, the present invention provides a flashlight with a power supply adapter.

An object of the present invention is to provide a flashlight with a power supply adapter, so that when the rechargeable battery in the flashlight is used up, the flashlight can still function, in order to facilitate working for continuous use.

Another object of the present invention is to provide a flashlight with a power supply adapter, so that with the spare battery and the appropriate circuit design, the rechargeable battery or the spare battery can be selected for use as desired; in order to enhance the function of the flashlight and to provide more flexibility for users.

In order to achieve the purposes mentioned above and other objectives, the present invention comprises a main body and a light in the front of the main body with a light bulb inside. The invention also comprises a compartment in the main body comprising a rechargeable battery compartment and a spare battery compartment. At least one rechargeable battery can be placed in the rechargeable battery compartment, and at least one spare battery can be placed in the spare battery compartment. There is also a switch for the rechargeable battery and a switch for the spare battery and a plug for recharging. The switch for the rechargeable battery is connected to a first circuit, and the first circuit is connected to the rechargeable battery and the light bulb. The switch for the spare battery is connected to a second circuit, which is connected to the spare battery and the light bulb.

According to the structure mentioned above, one terminal of the light bulb is connected to the rechargeable battery and the spare battery via the switches, and the other is electrically connected to the negative terminals of the batteries.

Also, for recharging, there is a positive terminal and a negative terminal in the plug for recharge. The positive and negative terminals are connected to the positive and negative terminals of the rechargeable battery in the rechargeable battery compartment accordingly.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
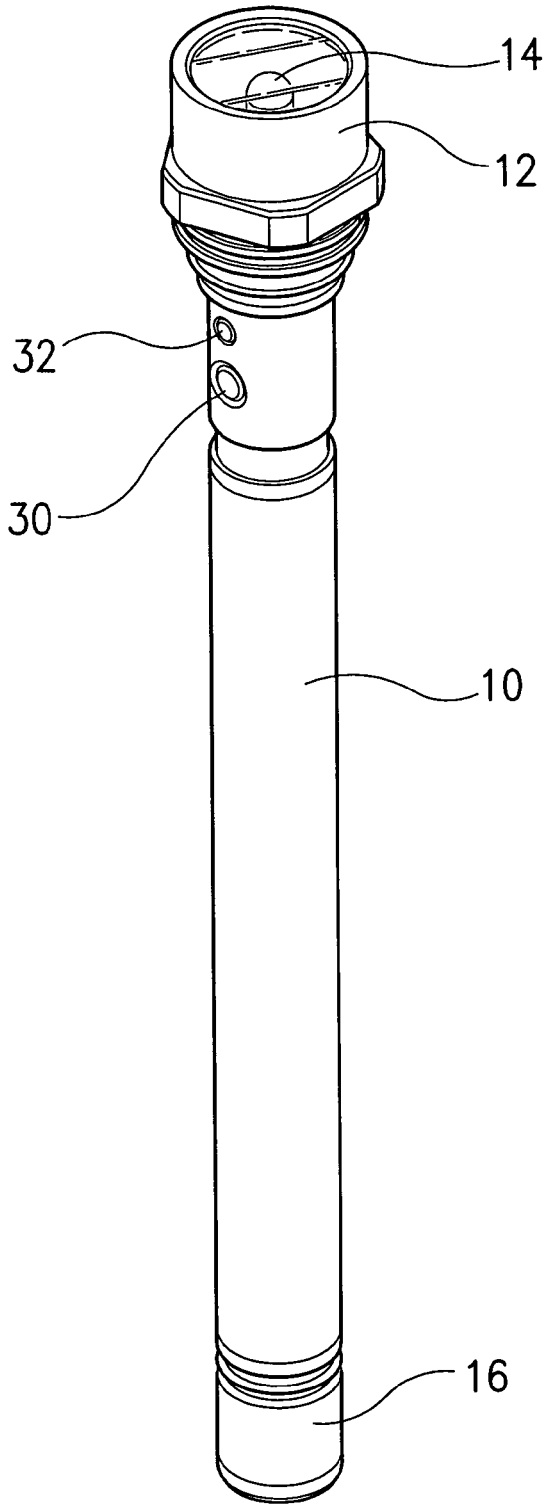
FIG. 1 is a 3-dimensional diagram illustrating components of a flashlight with power supply adapter according to an embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
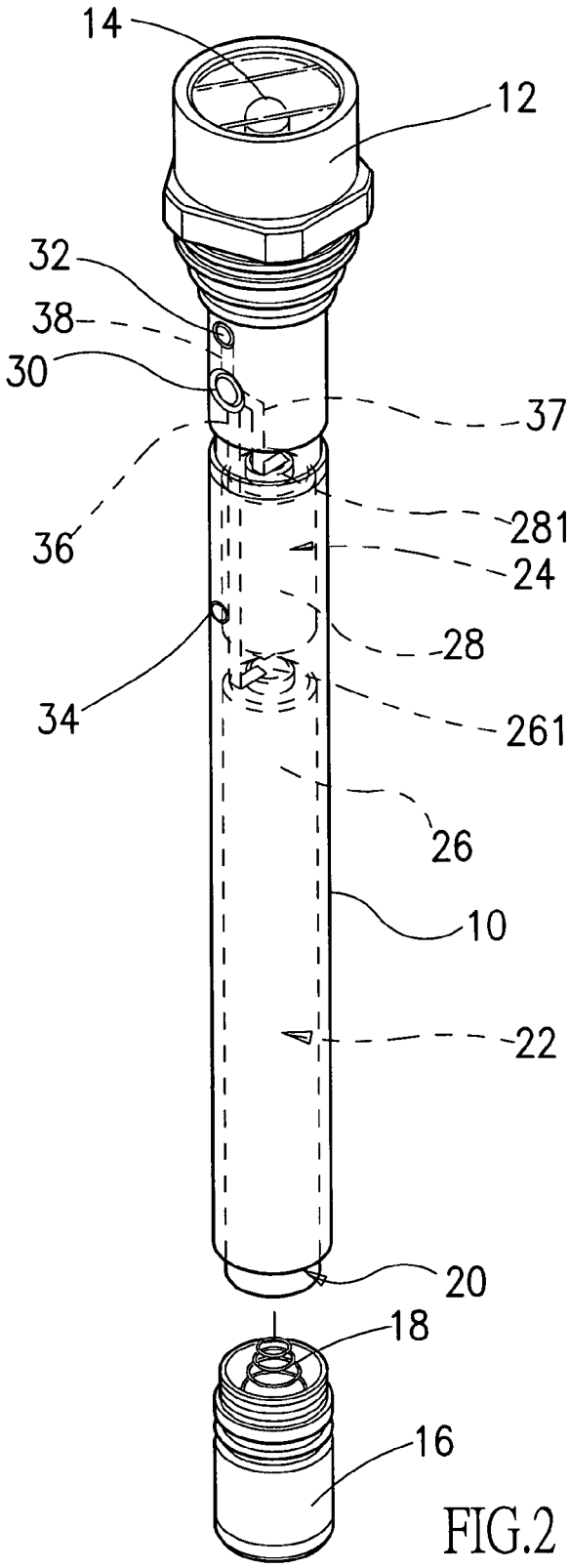
FIG. 2 is a diagram illustrating components of a flashlight with power supply adapter according to an embodiment of the present invention.
Figure 3:
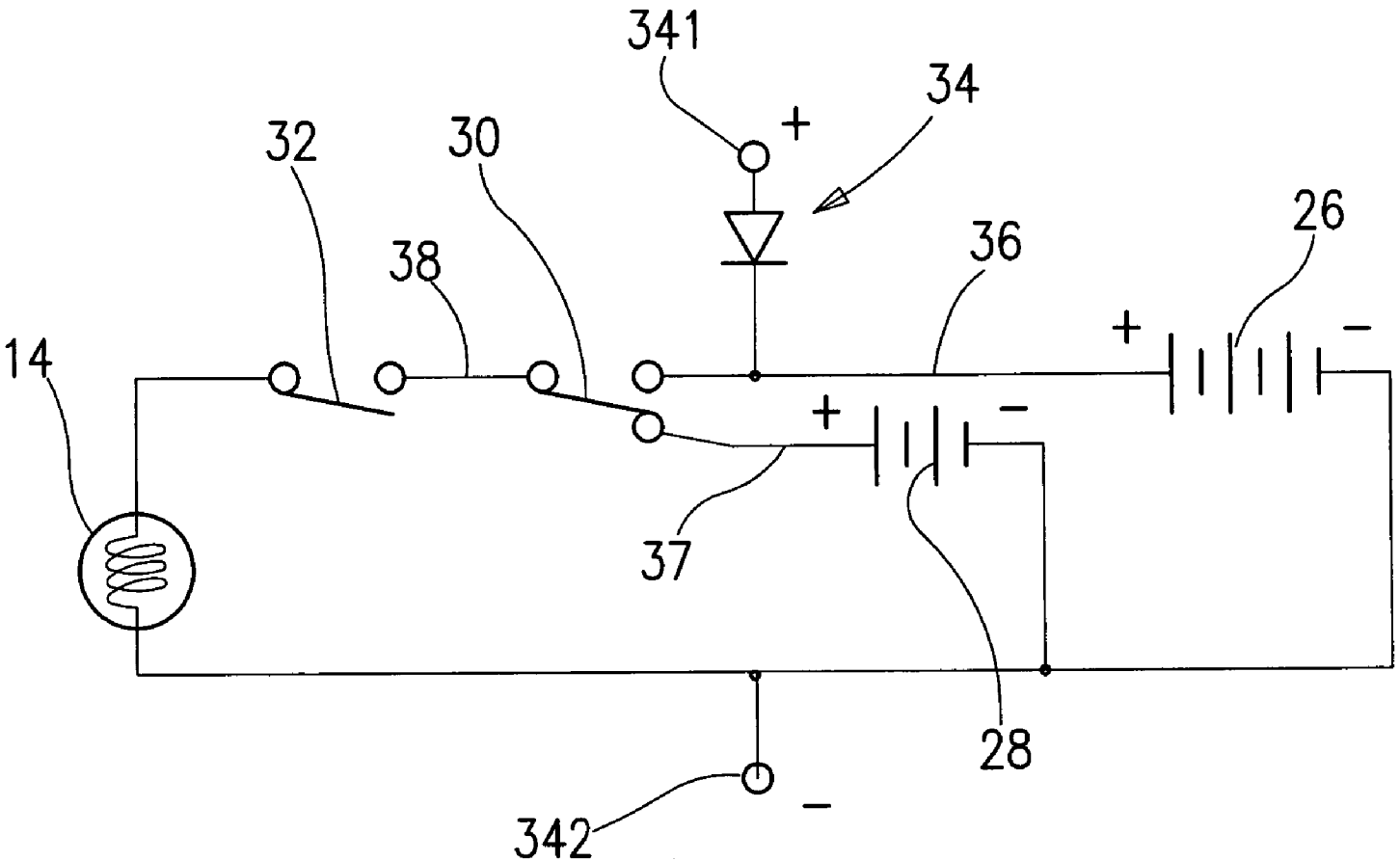
FIG. 3 is a circuit diagram illustrating circuitry of a flashlight with power supply adapter according to an embodiment of the present invention.

Refer to FIGS. 1 and 2 which are diagrams and exploded view of a flashlight with power supply adapter. The invention comprises a main body 10 of the flashlight. At the tip of the main body 10, there is a front light housing 12 and a light bulb. The end of the flashlight is threaded in a spiral shape in order to screw a rear cover 16 onto the main body 10. Further, there is a spring 18 inside the rear cover for tension after it is screwed onto the main body.

There is a compartment 20 in the main body 10 of the flashlight. The compartment 20 comprises a rechargeable battery compartment 22 and a spare battery compartment 24. A rechargeable battery 26 can be placed in the rechargeable battery compartment 22 and one spare battery 28 can be placed in the spare battery compartment 24. There is a battery switch 30 for switching between the rechargeable battery 30 and the spare battery 28. Also, there is an on/off switch 32 and a plug 34 for recharging. Once the on switch 32 is activated, the battery switch 30, when selecting the rechargeable battery 26, is connected to a first circuit 36, which is electrically connected to the positive terminal 261 of the rechargeable battery 26 and the light bulb 14 (see diagram). The switch 30, when selecting the spare battery 38, is electrically connected to a second circuit 38, which is electrically connected to the positive terminal 281 of the spare batter 28 and the light bulb 14.

The rechargeable battery 26 can be recharged by supplying power to the recharge plug 34, which is connected to the rechargeable battery 26 in the rechargeable battery compartment 22.

Please refer to Diagram 3, which is a circuit diagram of a flashlight with power supply adapter. The recharge plug has a positive terminal and a negative terminal. The positive terminal 341 and the negative terminal 342 are connected to the positive and negative terminals of the rechargeable battery 26 accordingly. When the battery select switch 30 is selected for the rechargeable battery 26 and the on switch 32 is on, the first circuit 36 is connected to the rechargeable battery 26 and the light bulb 14, causing the bulb 14 to light, which means the circuit is turned on. In doing so, the flashlight is using the electricity from the rechargeable battery 26. When the battery select switch 30 is selected for the spare battery 28 and the on switch 32 is on, the second circuit is connected to the spare battery 38 and the light bulb 14, and then the light is lit, which means the circuit is turned on.

Therefore, the spare battery 28 of the Invention is in the spare battery compartment 24. For normal usage, the battery select switch 30 is selected for the rechargeable battery 26, in order to use the electricity of the rechargeable battery 26. When the electricity of the rechargeable battery is completely used, then the switch is pressed to select the spare battery 32 and use the electricity of the spare battery 28, in order to solve the problem of no more electricity and still be able to use the flashlight. Of course, changing battery is more convenient than recharging battery outdoors. Therefore, further consideration of the work process and condition can even prolong the time of usage.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A flashlight with power supply adapter comprising:
a main body;
a front light housing connected to the main body;
a light bulb in the front light housing;
a compartment in the main body;
a rechargeable battery compartment for storing a rechargeable battery;
a spare battery compartment for storing is a spare battery;
a battery select switch for switching between the rechargeable battery and the spare;
a first circuit connecting the rechargeable battery and the light bulb;
a second circuit connecting the spare battery and the light bulb;
a rear cover connected to the main body;
a spring in the rear cover; and
a recharge plug connected to the rechargeable battery in the rechargeable battery compartment;
whereby one terminal of the light bulb is connected to the battery select switch, and another terminal is connected to negative terminals of the rechargeable batten and the spare.

2. The flashlight with power supply adapter of claim 1, whereby the rear cover is screwed onto the main body of the flashlight and the spring provides tension.

3. The flashlight with power supply adapter of claim 1, further comprising an on/off switch connected between the rechargeable and spare batteries and the light bulb.

4. A flashlight with power supply adapter comprising:
a main body;
a front light housing connected to the main body;
a light bulb in the front light housing;
a compartment in the main body;
a rechargeable battery compartment for storing a rechargeable battery;
a spare battery compartment for storing is a spare battery;
a battery select switch for switching between the rechargeable battery and the spare;
a first circuit connecting the rechargeable battery and the light bulb;
a second circuit connecting the spare battery and the light bulb; and
an on/off switch connected between the rechargeable and spare batteries and the light bulb;
whereby one terminal of the light bulb is connected to the on/off switch and another terminal of the light bulb is connected to the main body of flashlight.

5. The flashlight with power supply adapter of claim 1, whereby the recharge plug comprises a positive terminal connected to a positive terminal of the rechargeable battery and a negative terminal connected to a negative terminal of the rechargeable battery.

6. A flashlight with power supply adapter comprising:
a main body;
a front light housing connected to the main body;
a light bulb in the front light housing;
a compartment in the main body;
a rechargeable battery compartment for storing a rechargeable battery;
a spare battery compartment for storing is a spare battery;
a battery select switch for switching between the rechargeable battery and the spare;
a first circuit connecting the rechargeable battery and the light bulb;
a second circuit connecting the spare battery and the light bulb;
a rear cover connected to the main body;
a spring in the rear cover; and
a recharge plug connected to the rechargeable battery in the rechargeable battery compartment;
whereby one terminal of the light bulb is connected to the battery select switch, and another terminal is connected to negative terminals of the rechargeable battery and the spare.

7. The flashlight with power supply adapter of claim 6, whereby the rear cover is screwed onto the main body of the flashlight and the spring provides tension.

8. The flashlight with power supply adapter of claim 6, further comprising an on/off switch connected between the rechargeable and spare batteries and the light bulb.

9. The flashlight with power supply adapter of claim 8, whereby one terminal of the light bulb is connected to the on/off switch and another terminal of the light bulb is connected to the main body of flashlight.

10. The flashlight with power supply adapter of claim 6, whereby the recharge plug comprises a positive terminal connected to a positive terminal of the rechargeable battery and a negative terminal connected to a negative terminal of the rechargeable battery.

* * * * *